United States Patent [19]

Burrows

[11] Patent Number: 4,768,029

[45] Date of Patent: Aug. 30, 1988

[54] VIDEO DISPLAY SYSTEM WITH GRAPHICAL CURSOR

[75] Inventor: James E. Burrows, Alsager, Great Britain

[73] Assignee: International Computers Limited, London, England

[21] Appl. No.: 56,588

[22] Filed: Jun. 1, 1987

[30] Foreign Application Priority Data

May 28, 1986 [GB] United Kingdom ..... 8612930

[51] Int. Cl.[4] ..... G09G 1/16

[52] U.S. Cl. ..... 340/799; 340/709; 340/747

[58] Field of Search ..... 340/709, 710, 706, 723, 340/724, 747, 799

[56] References Cited

U.S. PATENT DOCUMENTS 4,566,000 1/1986 Goldman et al. ..... 340/709
4,706,074 11/1987 Muhich et al. ..... 340/709

FOREIGN PATENT DOCUMENTS 60-247730 12/1985 Japan ..... 340/709

*Primary Examiner*—Gerald L. Brigance
*Attorney, Agent, or Firm*—Lee & Smith

[57] ABSTRACT

A raster scanned video display for high resolution graphics on to which a graphical cursor can be superimposed. Cursor data corresponding to the next raster line of the image is read out of a data store during the line blanking interval and stored in a fast memory. During scanning of that next raster line the cursor data is combined with the image data. By combining the cursor data with the image data in this way, on a line-by-line basis, storage space requirements in the fast memory are greatly reduced.

18 Claims, 2 Drawing Sheets

VIDEO DISPLAY SYSTEM WITH GRAPHICAL CURSOR

BACKGROUND TO THE INVENTION

This invention relates to a video display system having a graphical cursor. More specifically, the invention is concerned with the problem of superimposing a graphical cursor onto a raster-scanned video display, e.g. for a high-resolution interactive graphics workstation.

In a typical high-resolution graphics display system, the display image is held in a store in the form of a bit map, i.e. each picture element (pixel) of the display is defined by the state of a single bit in the store (in the case of a monochrome display) or by the states of several bits (in the case of a grey-scale or colour display). In operation, data is read out of the store in synchronism with the raster scan of the display and converted to serial form to produce a video signal for driving the display.

Such a display system normally has a pointing device in the form of a "mouse" or similar transducer, for pointing to, and drawing on the display. The physical movements of the mouse are translated into x-y coordinates defining the position of a graphical cursor within the display image. The cursor normally consists of a rectangular area within the displayed image in which the stored image is modified, according to a specified algorithm, by the contents of a cursor bit-map also held within the store. The cursor may, for example, consist of 64×64 pixels.

In a conventional system of this kind, the whole of the cursor data is read from the store into a fast static memory during the frame-blanking interval of the display, when the store video data port is otherwise unoccupied. The cursor data is then read out of the fast memory, converted to serial form, and aligned and combined with the serialised image data in real-time to produce an output video signal representing the image with the cursor superimposed at the required position.

Problems with this method are as follows:

1. To combine image and cursor data streams after serialisation requires careful timing control of the serialising shift registers, with the control logic operating at pixel clock rate. As pixel clock rates rise into the VHF region (100 to 150 MHz is now not uncommon), this logic becomes increasingly difficult to implement.

2. A relatively large, fast memory is required to store the whole of the cursor. Whilst such memories are probably not a major overhead in an M.S.I. solution, they do not lend themselves to gate array solutions since they cannot be included in the array. This leads to the need for extra components in order to implement the memory and to increased I/O complexity for the gate array. It is desirable to be able to do the whole job in one gate array.

SUMMARY OF THE INVENTION

According to the invention, there is provided a video display system comprising:

(a) a store holding a first bit map defining an image and a second bit map defining a cursor to be superimposed on the image;

(b) a raster-scanned display device; characterised by (c) means operable during a line-blanking interval of the display device for reading out of the store cursor data representing a portion of the cursor bit map corresponding to the next raster line of the image, and storing that data in a fast memory; and (d) means operable during scanning of that next raster line, for reading out of the store image data representing the portion of the image bit map corresponding to that raster line and combining it with the contents of the fast memory to produce an output video signal.

Thus, it can be seen that in the present invention the cursor is read out of the store and combined with the image data on a line-by-line basis, rather than a whole frame at a time. As a result, the amount of fast storage required is greatly reduced, since the fast memory need only be capable of storing the portion of the cursor corresponding to a single raster line.

In a preferred form of the invention, the cursor data is pre-processed during the line-blanking interval so as to align it with respect to the image data, and the pre-processed cursor data is then combined with the image data, in real time during scanning of the next line of the display.

Preferably, the pre-processing of the cursor data and the combination of the pre-processed cursor data with the image data is performed in a bit-parallel manner (e.g. a byte at a time). This allows the clock frequency to be much lower than that required in a conventional display system where the data is handled serially (i.e. one bit at a time). Moreover, only one parallel-to-serial converter is required, whereas in a conventional system two converters would be required, one for the image data and one for the cursor data.

BRIEF DESCRIPTION OF THE DRAWINGS

One video display system in accordance with the invention will now be described by way of example with reference to the accompanying drawings.

DESCRIPTION OF AN EMBODIMENT OF THE INVENTION

Figure 1:
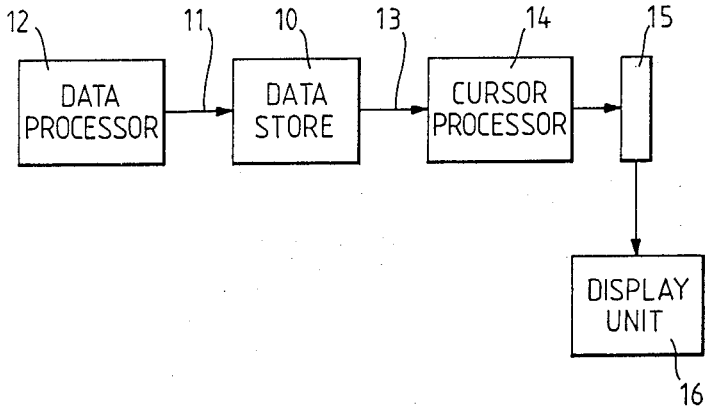
FIG. 1 is a block diagram of the system.

Referring to FIG. 1, this shows an overall view of the video display system. The system includes a data store 10 which holds a bit map representing an image consisting of 1024×1024 pixels. The image is monochrome, so that each pixel is represented by a single bit (0=white, 1=black). The entire image therefore occupies 131072 bytes of storage.

The store 10 also holds a bit map representing a cursor to be superimposed on the image. The cursor consists of 64×64 pixels, each pixel being represented by two bits A,B. In other words, the cursor bit map consists of two 64×64 planes of data, containing two bits A,B for each of the pixels in the cursor. Each of these planes occupies 512 bytes of storage.

The two bits A,B indicate the way in which the corresponding image pixel is to be modified by the cursor, as follows:

| A | B | Function |
|---|---|---|
| 0 | 0 | no change (displayed pixel = image pixel) |

-continued

| A | B | Function |
|---|---|---|
| 0 | 1 | complement (displayed pixel = inverse of image pixel) |
| 1 | 0 | black (displayed pixel is black) |
| 1 | 1 | white (displayed pixel is white) |

It can be seen that this corresponds to forming the OR function of the image pixel with bit A, and then forming the exclusive-OR of the result with bit B.

By setting the bits of the cursor bit map to suitable values, a variety of different cursors of different shapes and sizes can be produced.

The store 10 has a byte-wide read/write port 11 connected to a data processor 12, allowing the processor to read and write the image and cursor data as required. The store 10 also has a byte-wide read-only port 13, which is connected to a cursor processing unit 14. As will be described in detail below, the unit 14 combines the cursor and image data read from the store to produce an output representing the image with the cursor superimposed on it in the required position. The output of the unit 14 is fed to an 8-bit shift register 15 which converts it from parallel to serial form. The serial output of the shift register is fed to the video input of a raster-scanned video display unit 16.

Figure 2:
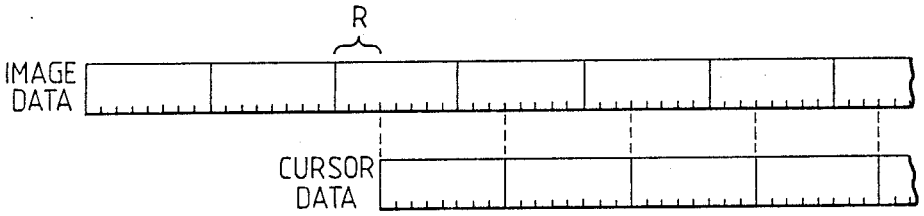
FIG. 2 shows image data corresponding to a raster line, and the corresponding portion of the cursor data.

Referring now to FIG. 2, this shows image data representing one raster line of the image, consisting of a stream of 128 bytes. FIG. 2 also shows the cursor data corresponding to this raster line, consisting of 8 bytes in each of the two cursor planes.

The cursor is not necessarily aligned with byte boundaries of the image and, in general, it is offset by R bits with respect to the byte boundaries. In FIG. 2, for example, the cursor is shown offset by 3 bits (i.e. R=3). One of the functions of the cursor processing unit 14, as will be described, is to pre-process the cursor so as to obtain the desired alignment with the image data.

Figure 3:
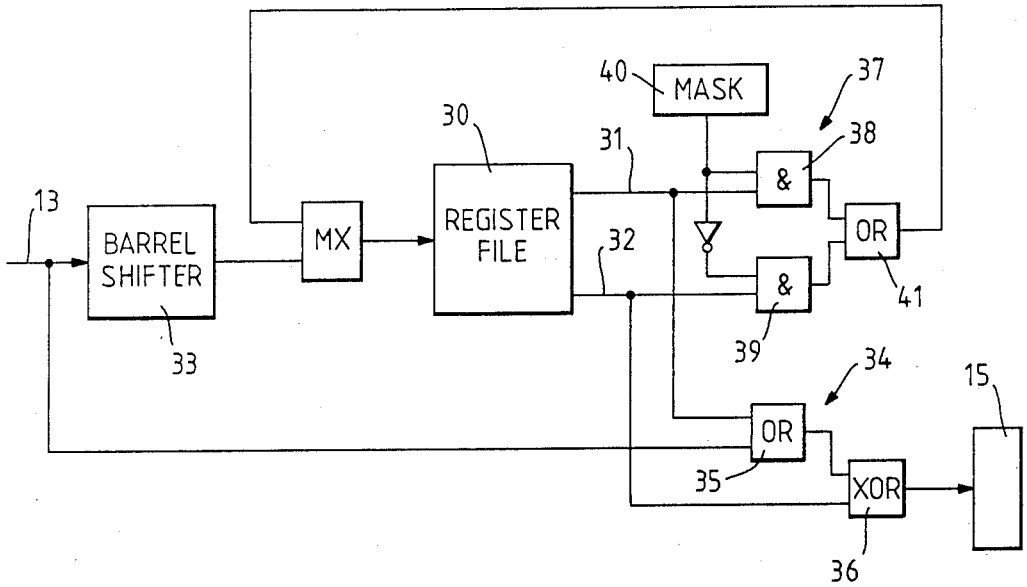
FIG. 3 shows a cursor processing unit forming part of the display system.

FIG. 3 shows the cursor processing unit in detail. This comprises a register file 30 which acts as a fast memory for buffering the cursor data. The register file has 18 eight-bit byte locations. Any two of these locations can be addressed simultaneously so as to read out two bytes in parallel from two output ports 31,32. Such register files are well known in the art and so need not be described in further detail.

A data byte from the output port 13 of the data memory 10 is applied to a barrel shifter 33, which performs a circular shift on each byte passing through it, so as to rotate it by a selected number of bit positions, from 0 to 7. The output of the barrel shifter 33 is fed to the data input of the register file 30 and can thus be written into any location of the register file.

The outputs of the register file are connected to a pixel transformation circuit 34, which combines the cursor data with the image data. The circuit 34 consists of a set of eight OR gates 35 which combine the output of the first port 31 with the image data from the memory 10. The outputs of the OR gates 35 are combined with the output byte from the second port 32 by means of a set of eight exclusive OR gates 36. The outputs of the gates 36 are fed to the parallel-to-serial shift register 15 to produce the output video signal for the display.

The outputs of the register file 30 are also fed to a mask and merge circuit 37. This consists of a set of eight AND gates 38 connected to the first output port 31, and a set of eight AND gates 39 connected to the second output port 32. The AND gates 38 are controlled by an eight-bit mask held in a mask register 40, while the gates 39 are controlled by the inverse of the mask. The outputs of the two sets of AND gates are combined in a set of eight OR gates 41, and the result is fed back to the input of the register file 30.

It can be seen that the effect of the mask and merge circuit 37 is to select a group of bits as specified by the mask from the output port 31, and a complementary group of bits from the other port 32, and to merge these together into a single byte.

Operation

Figure 4:
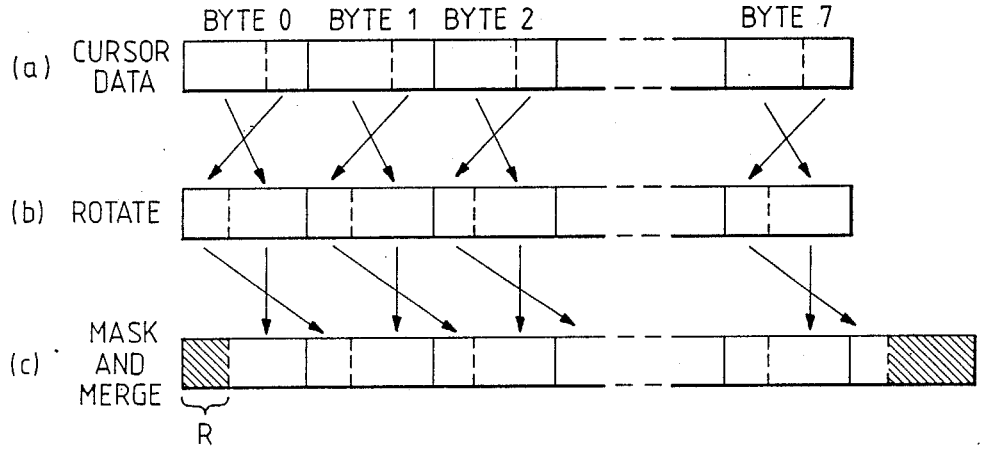
FIG. 4 illustrates the way in which the cursor processing unit aligns the cursor with respect to the image data.

The operation of the system will now be described with reference to FIG. 4.

During the line-blanking interval preceding each raster line in which the cursor is to appear, the corresponding line of cursor data is read out of the store 10 and written into the register file 30. This cursor data consists of 8 bytes from each of the two cursor planes (A,B). FIG. 4*a* represents the eight bytes from one of these planes.

Since the cursor may start at any pixel location of the image, not necessarily at a byte boundary, the bytes of the cursor data may not match up with the image data bytes they are required to transform. The cursor data is matched with the image data as follows:

Before it is written into the register file 30, each byte of the cursor data is rotated by an amount R corresponding to the offset between the cursor and image bytes. FIG. 4*b* shows the result of this rotation. The cursor data in the register file is then processed by the mask and merge circuit 37, so as to merge the first R bits of each byte with the last N-R bits of the next byte. In the case of the first byte, the last N-R bits are merged with an all-zero byte, and similarly in the case of the last byte, the first R bits are merged with an all-zero byte. The result of the mask and merge operation is written back into the register file.

The register file now holds 9 bytes for each plane of the cursor, as shown in FIG. 4*c*. It can be seen that the cursor data has been shifted R places to the right with respect to the byte boundaries and is therefore now correctly aligned with the image data. This operation is performed separately for each of the 2 planes (A,B).

During the raster linescan, the image data corresponding to this line is read from the store 10, a byte at a time, in synchronism with the scan. After a specified number of image data bytes has been read, reading of the cursor data from the register file commences. The cursor data is read out two bytes at a time, one byte from each of the two cursor planes (A,B) by way of the two register file output ports. These bytes are combined with the image data by means of the circuit 34, so as to modify the image data in accordance with the cursor.

It will be appreciated that, although the specific embodiment of the invention described above is a monochrome system, the invention is equally applicable to systems for displaying greyscale or colour images.

I claim:

1. A video display system comprising:

(a) a store holding a first bit map defining an image and a second bit map defining a cursor to be superimposed on the image;

(b) a raster-scanned display device;

(c) means operable during a line-blanking interval of the display device for reading out of the store cursor data representing a portion of the cursor bit map corresponding to the next raster line of the image, and storing that data in a fast memory; and (d) means operable during scanning of that next raster line, for reading out of the store image data representing the portion of the image bit map corresponding to that raster line and combining it with the contents of the fast memory to produce an output video signal.

2. A video display system as claimed in claim 1, including a cursor processing unit for pre-processing the cursor data prior to combining it with the image data so as to bring it into alignment with respect to the image data.

3. A video display system as claimed in claim 2, wherein the cursor processing unit is operative to pre-process the cursor data during the line blanking interval in which it is read from the store.

4. A video display system as claimed in claim 2, in which the pre-processing of the cursor data and the combination of the pre-processed cursor data with the image data is performed in a bit-parallel manner.

5. A video display system as claimed in claim 4, including means operative to convert the combined cursor data and image data from parallel to serial form, to produce said output video signal.

6. A video display system as claimed in claim 4, wherein the cursor processing unit comprises shifter means operative to rotate each group of N parallel bits of the cursor data by R bit positions.

7. A video display system as claimed in claim 6, wherein the shifter means rotates the cursor data prior to the cursor data being stored in the fast memory.

8. A video display system as claimed in claim 6, wherein the cursor processing unit further includes mask and merge means for merging the first R bits of each said group of N bits of the cursor data with the last N-R bits of the next group of N bits of the cursor data.

9. A video display system as claimed in claim 8, wherein the mask and merge means operates on the cursor data after it has been stored in the fast memory.

10. A method of superimposing a cursor on to an image displayed on a raster scanned display, including the steps of:

(a) holding in a store, a first bit map defining an image and a second bit map defining a cursor;

(b) reading out of the store, during a line blanking interval of the display, cursor data representing a portion of the cursor bit map corresponding to the next raster line of the image and storing that data in a fast memory; and (c) reading out of the store, during scanning of that next raster line, image data representing the portion of the image bit map corresponding to that raster line and combining it with the contents of the fast memory to produce an output video signal.

11. A method as claimed in claim 10, including the step of pre-processing the cursor data prior to combining it with the image data so as to bring it into alignment with respect to the image data.

12. A method as claimed in claim 11, wherein the step of pre-processing the cursor data is carried out during the line blanking interval in which it is read from the store.

13. A method as claimed in claim 11, wherein the steps of pre-processing the cursor data and the combination of the pre-processed cursor data with the image data are performed in a bit-parallel manner.

14. A method as claimed in claim 13, including the step of converting the combined cursor data and image data from parallel to serial form to produce said output video signal.

15. A method as claimed in claim 13, wherein the step of pre-processing the cursor data comprises rotating each group of N parallel bits of the cursor data by R bit positions.

16. A method as claimed in claim 15, wherein the step of rotating the cursor data is carried out prior to the cursor data being stored in the fast memory.

17. A method as claimed in claim 15, wherein the step of pre-processing the cursor data comprises merging the first R bits of each said group of N bits of the cursor data with the last N-R bits of the next group of N bits of the cursor data.

18. A method as claimed in claim 17, wherein the merging step is performed on the cursor data after it has been stored in the fast memory.

* * * * *